US007093816B2

(12) United States Patent
Lacan et al.

(10) Patent No.: US 7,093,816 B2
(45) Date of Patent: Aug. 22, 2006

(54) SEALED CONTAINER FILLED WITH WATER FOR MAKING ICE AND PACKAGE COMPRISING SAME

(76) Inventors: Thierry Lacan, 31, rue de la Ferme, 92200 Neuilly sur Seine (FR); Bruno Ledoux, 4, avenue de la Motte Picquet, 75007 Paris (FR)

( * ) Notice: Subject to any disclaimer, the term of this patent is extended or adjusted under 35 U.S.C. 154(b) by 0 days.

(21) Appl. No.: 10/363,027

(22) PCT Filed: Aug. 29, 2001

(86) PCT No.: PCT/FR01/02687

§ 371 (c)(1),
(2), (4) Date: Sep. 3, 2003

(87) PCT Pub. No.: WO02/18856

PCT Pub. Date: Mar. 7, 2002

(65) Prior Publication Data

US 2004/0026599 A1 Feb. 12, 2004

(51) Int. Cl.
*F25C 1/24* (2006.01)

(52) U.S. Cl. ..... 249/61; 249/121; 249/127; 426/106; 426/119; D15/90

(58) Field of Classification Search ..... 249/61, 249/121, 119, 127; 426/87, 106, 119, 122; D15/90

See application file for complete search history.

(56) References Cited

U.S. PATENT DOCUMENTS

| | | | | | |
|---|---|---|---|---|---|
| 1,988,117 | A | * | 1/1935 | Geyer | 249/127 |
| D159,356 | S | * | 7/1950 | Lippincott | D15/90 |
| 2,955,044 | A | * | 10/1960 | Tupper | D15/90 |
| 3,480,251 | A | * | 11/1969 | Pietrzak | 249/127 |
| 4,023,768 | A | * | 5/1977 | Herrera-Casasus | 249/127 |
| 4,831,840 | A | * | 5/1989 | Fletcher | 249/127 |
| 4,899,976 | A | * | 2/1990 | Cederroth et al. | 249/61 |
| 5,393,032 | A | * | 2/1995 | Cederroth | 249/61 |
| 5,976,588 | A | * | 11/1999 | Vincent | D15/90 |

FOREIGN PATENT DOCUMENTS

| | | | |
|---|---|---|---|
| FR | 1210323 | * | 3/1960 |
| FR | 2040845 | * | 1/1971 |

* cited by examiner

*Primary Examiner*—James P. Mackey

(57) ABSTRACT

The sealed container filled with liquid is designed for making ice. It comprises a tray having a peripheral wall closed on one side by a base and defining on the other side an opening for extracting the ice. The container comprises a seal for sealing the tray, which is sealed above the opening. The base has a deformation protruding inside the tray, which defines externally a transverse groove extending from one edge of the base to the other and opening at each of its extremities on the peripheral wall of the tray, this base having two ridges extending on both sides of the groove.

15 Claims, 2 Drawing Sheets

SEALED CONTAINER FILLED WITH WATER FOR MAKING ICE AND PACKAGE COMPRISING SAME

Figure 1:
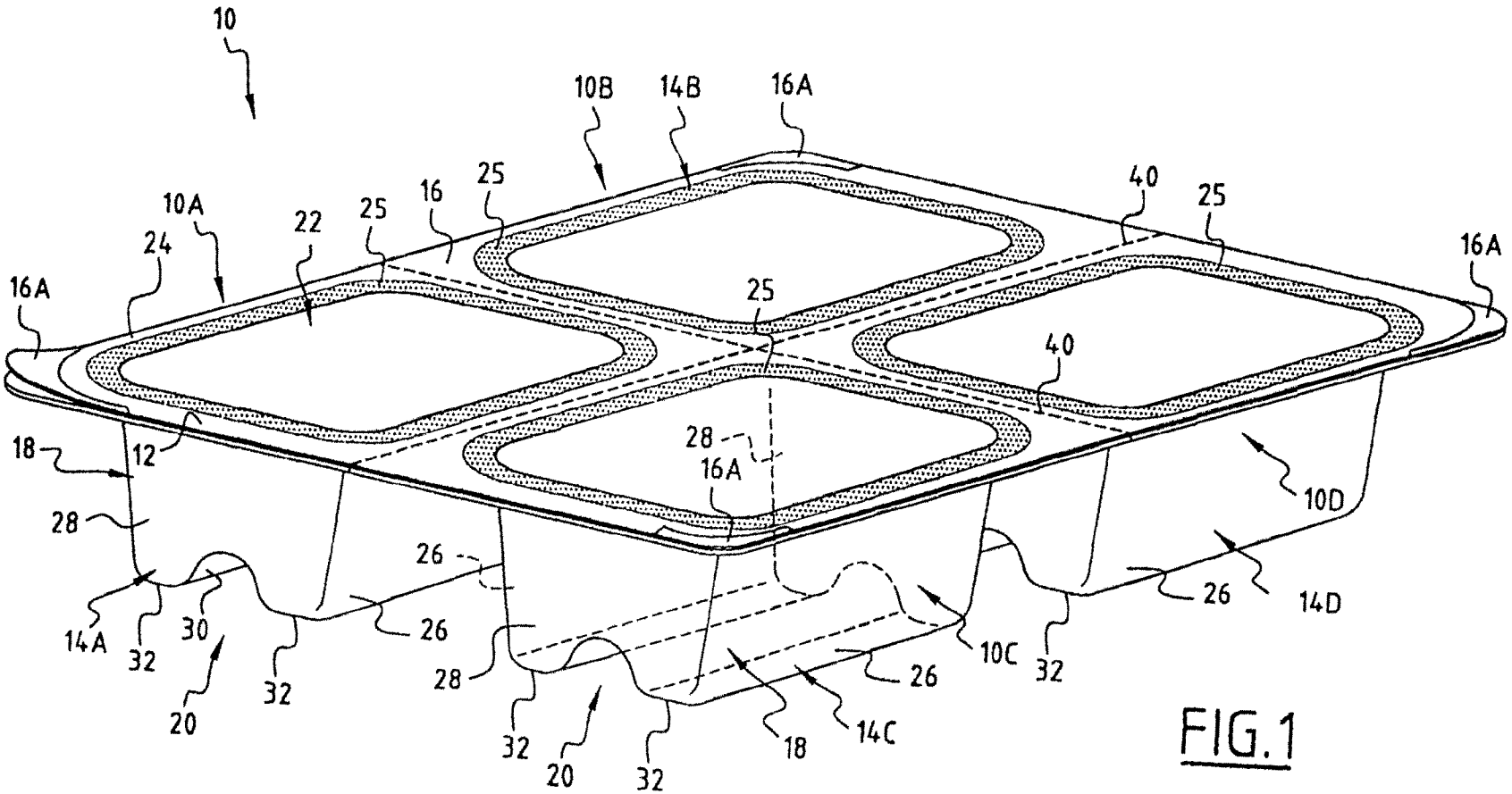

The present invention concerns a sealed container filled with water for making an ice cube, of the type comprising a tray having a peripheral wall closed on one side by a base and defining on the other side an opening for removing the ice, the container comprising an inner seal closing the tray sealed above the opening.

Such sealed containers assembled together are known. They are described, for example, in the patent U.S. Pat. No. 5,393,032.

In that document, each container has a substantially parallelepiped shape. It has four lateral faces closed at one extremity by a square base. In order to facilitate the unmolding of the ice, the base has a network of punctual protuberances that protrude inside the container. These protuberances weaken the base and facilitate its deformation for unmolding the ice.

However, the unmolding of the ice remains difficult. Indeed, in order to unmold the ice, it is necessary to press the base perpendicularly. Thus, it is appropriate during the pressing to firmly maintain the lateral wall of the container. The manipulation is difficult and often necessitates use of both hands by the person who desires to unmold the ice.

An aim of the present invention is to offer a container that makes it possible to easily unmold the ice, and in particular, allows the user to ensure the ejection of the ice with a single hand.

To this effect, an object of the present invention is a sealed container filled with water for making ice, of the above type, characterized in that the base has a deformation protruding toward the inside of the tray that defines externally a transverse groove extending from one side of the base to the other, this base presenting two ridges extending on both sides of the groove.

According to particular embodiments, the sealed container 30 has one or several of the following characteristics

- the base has a longest dimension, and the groove extends along the long longest dimension of the base;
- the base is rectangular, and the groove extend in the median part of the base;
- the groove has externally a concave base, which is connected tangentially to the top of the ridges adjacent to the groove;
- the peripheral wall widens progressively from the base toward the opening, the peripheral wall having backing-off lateral faces;
- the inner seal comprises inscriptions; and
- the opening is bordered by a peripheral external edge extending the peripheral edge, and the inner seal is sealed on the said peripheral external edge.

In addition, an object of the invention is a conditioning for making ice, characterized in that it comprises at least two containers as described above, adjacent to each other, the peripheral walls of adjacent trays being integral with each other, and in that weakening lines are provided on the edges between adjacent trays to make it possible to separate the trays.

Figure 2:
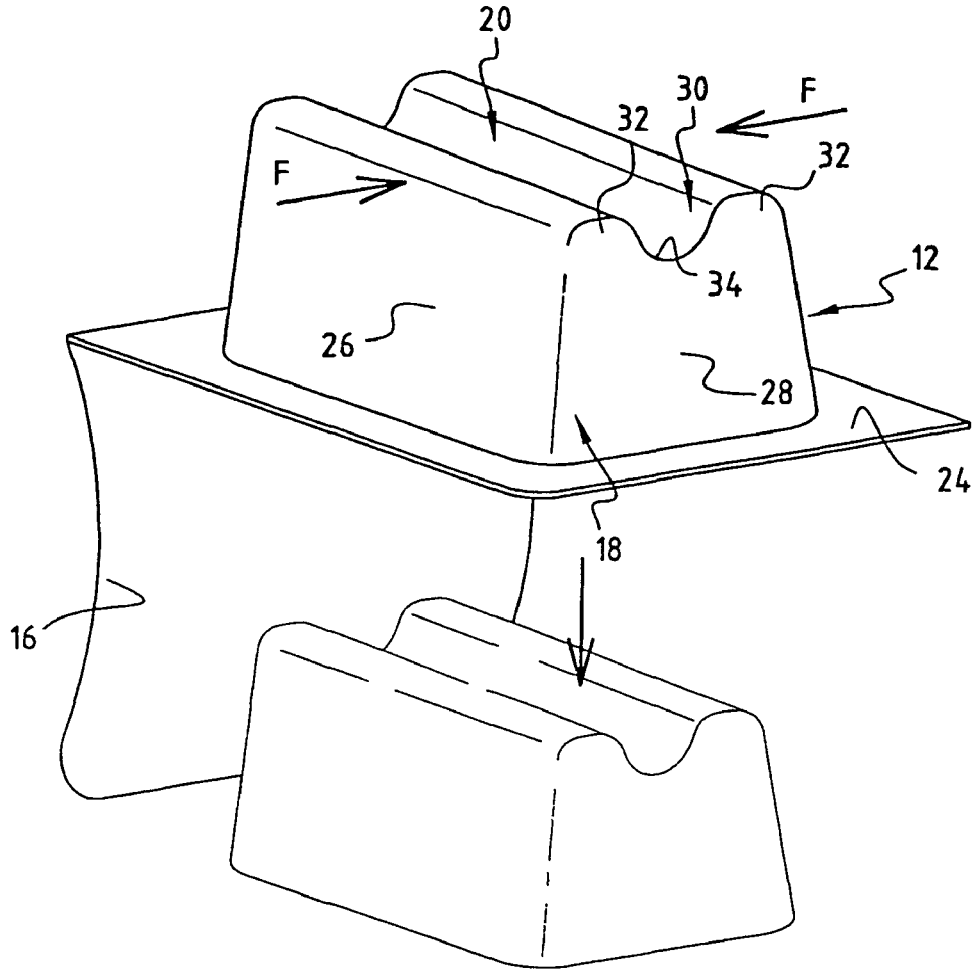

The invention will be understood better by reading the following description of exemplary embodiments, in reference to drawings in which:

FIG. 1 is a perspective view of a conditioning for making ice incorporating several sealed containers according to the invention, FIG. 2 is a perspective view of a container according to the invention during an ice unmolding phase.

The conditioning 10 shown on FIG. 1 is for making four food-grade ice cubes, each formed by a bloc of ice that can be used to cool a drink contained in a glass.

The conditioning 10 is made by four containers 10A, 10B, 10C, 10D according to the invention, each defining a closed space containing a determined amount of water for making a single ice cube and an air bubble sufficient to compensate the expansion of water during freezing. The containers are connected to each other to form a sheet.

More precisely, the conditioning 10 comprises a plate 12 made by a sheet of thermoformed polymer in which are defined four cells 14A, 14B, 14C, 14D each forming one tray of a container. Each cell is filled with water and is closed by a common sealing sheet 16 sealed on the plate 12 at the periphery of each cell. In a variant, the plate 12 has only two trays.

The external surface of the sealing sheet 16 defines a flat surface designed to be provided with printings of any kinds, and in particular, advertising or promotional information.

Each tray has a peripheral lateral wall 18 closed on one side by a base 20 and defining on the other side an opening 22 for extracting the ice. This opening is initially sealed by the sealing sheet 16.

The opening 22, of a generally rectangular shape, is bordered by a peripheral external edge 24 extending the peripheral wall 18. The four trays defined in the plate 12 are integral with each other in the area of their peripheral edge 24.

The sealing sheet 16 is sealed on each tray on the edge 24 of the opening 22, along a peripheral welding 25 illustrated by a dot network.

For each tray, a corner 16A of the sealing sheet 16 is kept free and is not welded to the edge 24. It forms a grasping edge that makes it possible to grasp the sheet easily in order to remove it.

Each tray defines a generally parallelepiped closed space. Thus, the peripheral wall 18 has four faces extending substantially perpendicularly to each other. They thus have two main faces 26 having a longer length and two transverse faces 28 having a shorter length.

Each of the faces 26 and 28 are backing off in order to facilitate extraction of the ice. Thus, the peripheral face 18 defines, along planes parallel to the plane in which the opening 22 extends, a contour having a transverse section that diminishes progressively from the opening 22 toward the base 20. In other words, the peripheral wall 18 opens from the base 20 to the opening 22.

As illustrated also on FIG. 2, the base 20 of each tray has an inner deformation protruding inside the tray. This deformation defines externally a transverse groove 30 extending from one extremity of the base to the other, and ending at each of its extremities on the peripheral lateral wall 18 of the tray. The groove or furrow 30 opens on the base of the tray on the side opposite the closed spaced filled with water.

Advantageously, the groove 30 extends parallel to the main face 26 having the longer length of the container. This groove is advantageously defined in the median part of the base. It defines on both sides, on the base, two lateral ridges 32 formed at the bottom of the principal faces 26. The groove 30, as well as the lateral ridges 32, are straight.

The groove 30 has a base 34 having a substantially curved transverse section whose concavity is oriented toward the outside of the container. The base 34 is connected to the top of each ridge 32 by a flange having a continuously derivable profile, whose concavity orientation reverts itself in the median part of the flange, the flange being connected tangentially to the top of the ridge 32.

The groove 30 extends over substantially one third of the width of the base 20. Thus, each of the ridges 32 and the groove 30 extends over about a third of the width of the base 20.

The depth of the groove 30, and thus the height of the ridges 32, is substantially equal to the width of the groove 30. The depth of the groove 30 is, for example, equal to a quarter of the total depth of a tray.

The depth and the width of the groove are much higher than the thickness of the polymer sheet forming the plate 12, which sheet can be manually deformed.

As illustrated on FIG. 1, the trays 14A to 14D, which are made integral with each other through the peripheral edges 24, are provided between them with weakening lines 40, which are formed, for example, by successive cuts forming pre-cuts between the trays.

The pre-cuts make it possible to rupture the plate 12, and thus, to separate the containers.

In a plate comprising four trays, a single weakening line can be provided to make it possible to separate the trays by groups of two.

The sealing sheet 16 is also pre-cut by the same cut as those provided on the plate 12.

One understands that a conditioning, as illustrated on FIG. 1, makes it possible to make ice from water contained in each container.

In order to use the ice, the containers, which are initially connected to each other, are separated by rupture along the weakening lines 40. The sealing sheet of a container is taken off by peeling, causing the rupture of the peripheral welding 25. The thus open tray is then overturned so that its opening 22 is oriented toward the bottom. The fingers of the user are applied on both sides of the ridges 32 and a pressing force is applied so as to bring the ridges closer to each other, as illustrated by arrow F.

This bringing together of the ridges 32 is made possible by the presence of the groove 30 which functions as a hinge. Under this bringing together force, the ice tends to be expelled through the opening 22 of the tray. Indeed, the pressing force applied by the fingers on the ridges 32 for the deformation of the base creates a force on the ice by cam effect, this force being applied along a direction perpendicular to the main plane of the opening 22.

After initiation of the ice movement, the ice leaves the container due to the generally widening shape of the latter toward the opening 22.

One understands that the presence along the whole length of the base of the container of the longitudinal groove or furrow opening at both of its extremities makes it possible to define on both sides of the ice two independent deformable ridges. Thus, the base has generally in its median part a folding or articulating line which makes it possible for the user, by a pressing force applied on both sides of the base, to apply an extracting force on the ice during deformation of the base.

The groove 20 opening at both of these extremities, this deformation can be obtained easily over the whole length of the ice.

Thus, unmolding of the ice is facilitated.

In a variant, each container is filled with water to which syrup has been added.

What is claimed is:

1. Sealed container filled with water for making ice, of the type comprising a tray having a peripheral wall closed on one side by a base and defining on the other side an opening for extracting the ice, the container comprising an inner seal for sealing the sealed tray above the opening, wherein the base has a deformation protruding inside the tray that defines externally a transverse groove extending from one side of the base to the other and opening at each of its extremities on the peripheral wall of the tray, this base having two ridges extending on both sides of the groove, and wherein, the base having a substantially rectangular outline, the groove extends in the median part of the base substantially over a third of the width of said base and has externally a concave base having a substantially curved transverse section whose concavity reverts itself in a median part of a flange that is connected tangentially to the top of the ridges, the depth of the groove and thus the height of the ridges being substantially the same as the width of said groove, and the concave base of the groove having a bottom in a straight line from one of its extremities to the other.

2. Container according to claim 1, wherein the base closing the peripheral wall has a longer dimension and the groove extends over the longer dimension of the base closing the peripheral wall.

3. Container according to claim 1, wherein the peripheral wall widens progressively from the base closing the peripheral wall to the opening, the peripheral wall having backing-off lateral faces.

4. Container according to claim 1, wherein the inner seal comprises inscriptions.

5. Container according to claim 1, wherein the opening is bordered by a peripheral external edge extending a peripheral edge of the opening, and the inner seal is sealed on the said peripheral external edge.

6. Conditioning for making ice, which comprises at least two containers according to claim 5 adjacent to each other, the peripheral external edges of adjacent trays being made integral with each other, and wherein weakening lines are provided on the peripheral external edges between adjacent trays to make it possible to separate the trays.

7. Container according to claim 2, wherein the peripheral wall widens progressively from the base closing the peripheral wall to the opening, the peripheral wall having backing-off lateral faces.

8. Container according to claim 2, wherein the inner seal comprises inscriptions.

9. Container according to claim 3, wherein the inner seal comprises inscriptions.

10. Container according to claim 2, wherein the opening is bordered by a peripheral external edge extending a peripheral edge of the opening, and the inner seal is sealed on the said peripheral external edge.

11. Container according to claim 3, wherein the opening is bordered by a peripheral external edge extending a peripheral edge of the opening, and the inner seal is sealed on the said peripheral external edge.

12. Container according to claim 4, wherein the opening is bordered by a peripheral external edge extending a peripheral edge of the opening, and the inner seal is sealed on the said peripheral external edge.

13. Conditioning for making ice, which comprises at least two containers according to claim 10 adjacent to each other, the peripheral external edges of adjacent trays being made integral with each other, and wherein weakening lines are provided on the peripheral external edges between adjacent trays to make it possible to separate the trays.

14. Conditioning for making ice, which comprises at least two containers according to claim 11 adjacent to each other, the peripheral external edges of adjacent trays being made integral with each other, and wherein weakening lines are provided on the peripheral external edges between adjacent trays to make it possible to separate the trays.

15. Conditioning for making ice, which comprises at least two containers according to claim 12 adjacent to each other, the peripheral external edges of adjacent trays being made integral with each other, and wherein weakening lines are provided on the peripheral external edges between adjacent trays to make it possible to separate the trays.

* * * * *